US007520267B2

(12) United States Patent
Toyoshima

(10) Patent No.: US 7,520,267 B2
(45) Date of Patent: Apr. 21, 2009

(54) FUEL INJECTION APPARATUS HAVING FUEL SUPPLIER FOR DISPLACEMENT AMPLIFYING CHAMBER

(75) Inventor: Yoshio Toyoshima, Chiryu (JP)

(73) Assignee: Denso Corporation, Kariya (JP)

( * ) Notice: Subject to any disclaimer, the term of this patent is extended or adjusted under 35 U.S.C. 154(b) by 180 days.

(21) Appl. No.: 11/546,313

(22) Filed: Oct. 12, 2006

(65) Prior Publication Data

US 2007/0079807 A1 Apr. 12, 2007

(30) Foreign Application Priority Data

Oct. 12, 2005 (JP) ..... 2005-297412

(51) Int. Cl.
*F02M 63/00* (2006.01)
*F02M 69/54* (2006.01)

(52) U.S. Cl. ..... 123/447; 123/457

(58) Field of Classification Search ..... 123/446–447, 123/457–458, 467
See application file for complete search history.

(56) References Cited

U.S. PATENT DOCUMENTS

| | | | | |
|---|---|---|---|---|
| 3,507,263 | A * | 4/1970 | Long | 123/455 |
| 4,142,497 | A * | 3/1979 | Long | 123/456 |
| 6,092,509 | A * | 7/2000 | Tanabe et al. | 123/447 |
| 6,112,721 | A * | 9/2000 | Kouketsu et al. | 123/447 |
| 6,378,498 | B2 * | 4/2002 | Kohketsu et al. | 123/447 |
| 6,615,807 | B2 * | 9/2003 | Rembold et al. | 123/516 |
| 6,684,856 | B2 * | 2/2004 | Tanabe et al. | 123/447 |
| 6,899,069 | B2 | 5/2005 | Mattes et al. | |
| 2004/0016421 | A1 | 1/2004 | Mattes | |
| 2005/0045150 | A1 | 3/2005 | Furukubo et al. | |

FOREIGN PATENT DOCUMENTS

| | | |
|---|---|---|
| EP | 1 359 306 A2 | 3/2003 |
| JP | 2005-507053 | 3/2005 |

OTHER PUBLICATIONS

Examination Report dated Oct. 23, 2007 in German Patent Application No. 10 2006 035 340.4-13 with English translation.

* cited by examiner

*Primary Examiner*—Thomas N Moulis
(74) *Attorney, Agent, or Firm*—Nixon & Vanderhye, PC

(57) ABSTRACT

According to the present invention, a fuel injection apparatus includes a high-pressure passage, a low-pressure passage, an actuator, a first and a second piston, a displacement amplifying chamber, a fuel injection mechanism, and a fuel supplier. The high-pressure passage is configured to be filled with high-pressure fuel. The low-pressure passage is configured to be filled with low-pressure fuel. The first piston is configured to be displaced by the actuator. The displacement amplifying chamber communicates with the low-pressure passage and works to amplify and transmit to the second piston a displacement of the first piston by means of the low-pressure fuel therein. The fuel injection mechanism is configured to inject the high-pressure fuel into a cylinder of an internal combustion engine in response to the displacement of the second piston. The fuel supplier works to supply the high-pressure fuel from the high-pressure passage through pressure reduction directly to the low-pressure passage.

7 Claims, 3 Drawing Sheets

FUEL INJECTION APPARATUS HAVING FUEL SUPPLIER FOR DISPLACEMENT AMPLIFYING CHAMBER

CROSS-REFERENCE TO RELATED APPLICATION

This application is based on and claims priority from Japanese Patent Application No. 2005-297412, filed on Oct. 12, 2005, the content of which is hereby incorporated by reference into this application.

BACKGROUND OF THE INVENTION

1. Technical Field of the Invention

The present invention relates to fuel injection apparatuses or systems for injecting fuel into cylinders of internal combustion engines. More particularly, the invention relates to a fuel injection apparatus for a diesel engine of a motor vehicle, which has a displacement amplifying chamber formed therein and includes a fuel supplier for promptly filling up the displacement amplifying chamber with low-pressure fuel after start of the engine.

2. Description of the Related Art

An existing fuel injection apparatus, which is incorporated in a common rail fuel injection system for a diesel engine of a motor vehicle, includes a high-pressure passage, a low-pressure passage, an actuator, a first and a second piston, a displacement amplifying chamber, and a fuel injection mechanism.

The high-pressure passage is hydraulically connected to a common rail of the system so as to be filled with high-pressure fuel. The low-pressure passage is configured to be filled with leak fuel from the high-pressure passage under a predetermined pressure. The actuator works to displace the first piston. The displacement amplifying chamber, which communicates with the low-pressure passage, works to amplify and transmit to the second piston a displacement of the first piston by means of the low-pressure fuel therein. The fuel injection mechanism is configured to inject the high-pressure fuel from the high-pressure passage into a cylinder of the engine in response to the displacement of the second piston.

In addition to the fuel injection apparatus, the fuel injection system generally includes a feed pump hydraulically connected to a fuel tank and a high-pressure pump hydraulically connected to the common rail. The feed pump works to prepressurize and feed to the high-pressure pump fuel from the fuel tank. The high-pressure pump works to further pressurize the fuel from the feed pump to a high pressure and supply the resultant high-pressure fuel to the common rail.

In such a fuel injection system, when there is contained adequate fuel in the fuel tank, the feed pump will suck in only the fuel from the fuel tank. However, when there is left only an extremely small amount of the fuel in the fuel tank, the feed pump will suck in air along with the fuel from the fuel tank. The sucked in air is then introduced into the high-pressure pump, the common rail, the high-pressure and low-pressure passages, and the displacement amplifying chamber, and exists in those places in the form of fine air bubbles.

During operation of the fuel injection apparatus, the low-pressure passage is always filled with the leak fuel from the high-pressure passage under the predetermined pressure. Accordingly, in the displacement amplifying chamber which communicates with the low-pressure passage, the air bubbles are kept small and the fuel density is kept high. Consequently, the displacement amplifying chamber keeps functioning normally.

However, when the fuel injection system is stopped along with the engine, the low-pressure fuel in the low-pressure passage comes to leak out via a check valve that is hydraulically connected to the low-pressure passage to regulate the fuel pressure therein to the predetermined pressure. Consequently, in the displacement amplifying chamber, the fuel pressure decreases accordingly, so that the fine air bubbles grow into large air bubbles and the fuel density decreases (i.e., the percentage of the air bubbles increases).

Further, when the fuel injection system is restarted along with the engine, a certain time period is required for refilling up both the low-pressure passage and the displacement amplifying chamber with the leak fuel from the high-pressure passage and rebuilding the fuel pressure therein up to the predetermined pressure.

Consequently, during the certain time period, the large air bubbles are compressed within the displacement amplifying chamber, so that the displacement amplifying chamber cannot function normally, and thus the fuel injection mechanism cannot inject the high-pressure fuel into the cylinder of the engine in a timely manner.

To solve such a problem, U.S. Pat. No. 6,899,069 discloses an approach according to which: part of the fuel discharged from a feed pump 13 is supplied to a system region 21 (corresponding to the low-pressure passage) via a diversion conduit 38; and filling of a hydraulic coupler 29 (corresponding to the displacement amplifying chamber) disposed within the system region 21 is carried out via an annular leakage gap that is formed between a bore 25 and a piston 24 inserted in the bore 25.

However, the main function of the feed pump 13 is to feed the fuel discharged therefrom to a high-pressure pump 12; thus, only a minority of the fuel discharged from the feed pump 13 is available for supplying the system region 21 . Consequently, with the limited amount of the fuel, it is difficult to promptly fill up the hydraulic coupler 29 after start of the engine.

On the contrary, if the amount of the fuel supplied to the system region 21 is increased for the purpose of promptly filling up the hydraulic coupler 29, the amount of the fuel fed to the high-pressure pump 12 would be accordingly decreased, so that the high-pressure pump 12 cannot supply adequate high-pressure fuel to the common rail and thus to the high-pressure passage.

SUMMARY OF THE INVENTION

The present invention has been made in view of the above-mentioned problem.

It is, therefore, a primary object of the present invention to provide a fuel injection apparatus for an internal combustion engine, which can promptly fill up a displacement amplifying chamber formed therein with low-pressure fuel after start of the engine, thereby initiating fuel injection in a timely manner.

According to the present invention, there is provided a fuel injection apparatus which includes a high-pressure passage, a low-pressure passage, an actuator, a first and a second piston, a displacement amplifying chamber, a fuel injection mechanism, and a fuel supplier.

The high-pressure passage is configured to be filled with high-pressure fuel. The low-pressure passage is configured to be filled with low-pressure fuel. The first piston is configured to be displaced by the actuator. The displacement amplifying chamber communicates with the low-pressure passage and works to amplify and transmit to the second piston a displacement of the first piston by means of the low-pressure fuel therein. The fuel injection mechanism is configured to inject the high-pressure fuel into a cylinder of an internal combustion engine in response to the displacement of the second piston. The fuel supplier works to supply the high-pressure fuel from the high-pressure passage through pressure reduction directly to the low-pressure passage.

Having the fuel supplier, it is possible for the fuel injection apparatus to minimize the time required to fill up the displacement amplifying chamber with the low-pressure fuel after start of the engine, thereby initiating the fuel injection in a timely manner.

According to a further implementation of the invention, the fuel supplier is configured with a first regulating valve, a supply passage, and a second regulating valve. The first regulating valve works to regulate pressure of the high-pressure fuel to a first predetermined pressure. The supply passage hydraulically connects the first regulating valve to the low-pressure passage. The second regulating valve works to regulate pressure of the low-pressure fuel to a second predetermined pressure.

With the above configuration, it is possible to regulate both the fuel pressures in the high-pressure and low-pressure passages and to reliably fill up the displacement amplifying chamber with the low-pressure fuel under the second predetermined pressure.

The fuel injection apparatus is incorporated in a common rail fuel injection system for a diesel engine, and the high-pressure passage communicates with a common rail of the system. Further, the first regulating valve is a pressure reducing valve that is installed to the common rail to regulate fuel pressure in the common rail.

With the above configuration, it is possible to utilize the pressure reducing valve that has already existed in the common rail fuel injection system, thereby minimizing the manufacturing cost of the fuel injection apparatus.

The second regulating valve is a check valve that is hydraulically connected to the low-pressure passage.

The low-pressure passage is also configured to receive leak fuel from the high-pressure passage, as in the existing fuel injection apparatus described previously.

The fuel injection mechanism is configured with: a casing; a pressure chamber formed within the casing; a control valve configured to be actuated by the second piston to control fuel pressure in the pressure chamber; a fuel sump formed within the casing and communicating with the high-pressure passage; at least one injection hole formed through the casing to communicate with the fuel sump; and a nozzle needle configured to be moved within the casing in accordance with the fuel pressure in the pressure chamber to selectively open and close the injection hole.

BRIEF DESCRIPTION OF THE DRAWINGS

The present invention will be understood more fully from the detailed description given hereinafter and from the accompanying drawings of the preferred embodiment of the invention, which, however, should not be taken to limit the invention to the specific embodiment but are for the purpose of explanation and understanding only.

In the accompanying drawings.

DESCRIPTION OF THE PREFERRED EMBODIMENT

The preferred embodiment of the present invention will be described hereinafter with reference to FIGS. 1-4.

Figure 1:
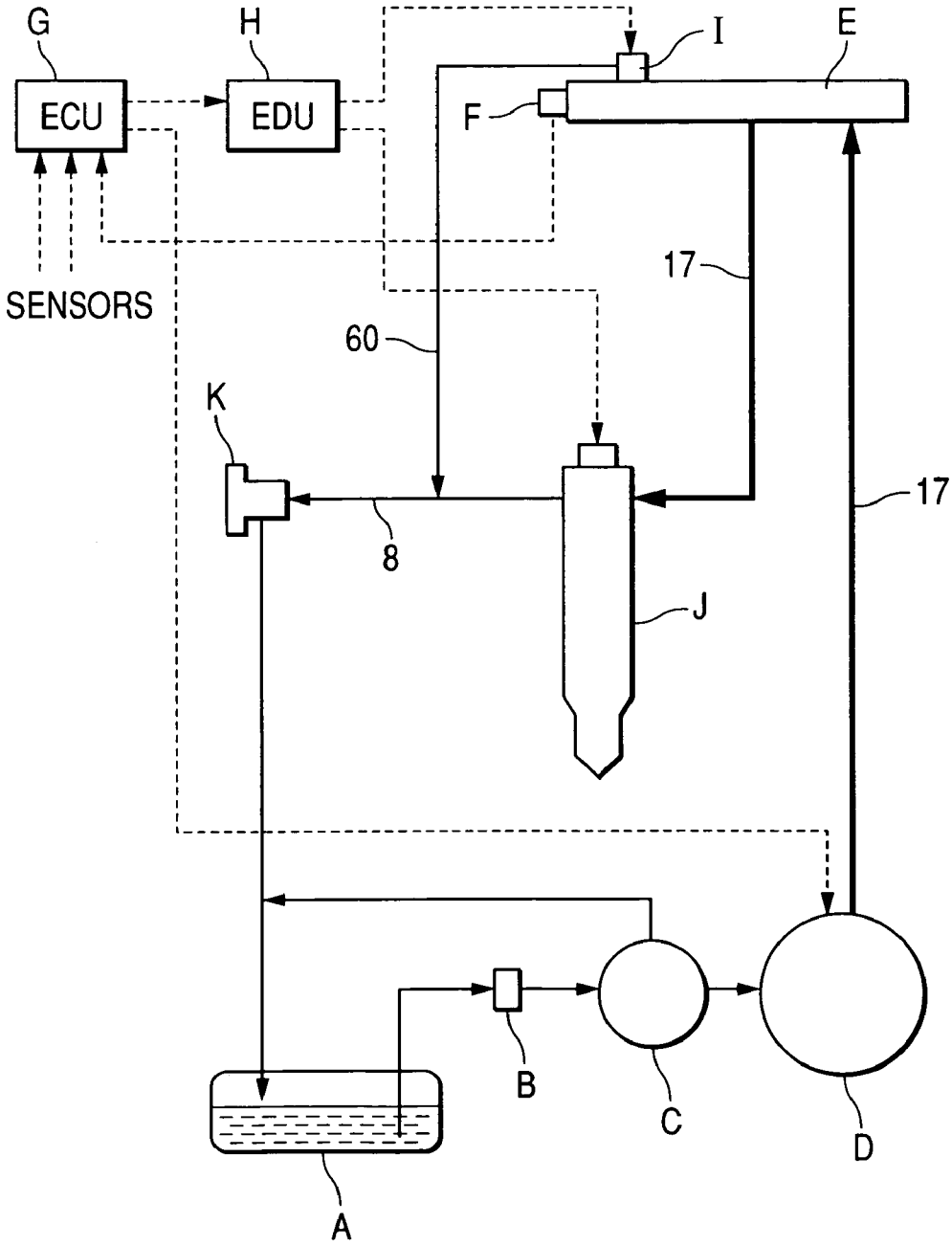
FIG. 1 is a schematic diagram showing the overall configuration of a common rail fuel injection system which incorporates therein a fuel injection apparatus according to an embodiment of the invention.

FIG. 1 shows the overall configuration of a common rail fuel injection system for a diesel engine of a motor vehicle, which incorporates therein a fuel injection apparatus according an embodiment of the present invention.

As shown in FIG. 1, fuel contained in a fuel tank A is drawn by a feed pump C through a filter B and fed to a high-pressure pump D.

The high-pressure pump D pressurizes the fuel to a high pressure and supplies the resultant high-pressure fuel to a common rail E. The high-pressure pump D is driven by the engine (not shown) and has a sufficiently large discharge rate, so that it can quickly fill up the common rail E with the high-pressure fuel after start of the engine.

A pressure sensor F is installed to the common rail E to sense the fuel pressure in the common rail E. The pressure sensor F provides a pressure signal indicative of the sensed fuel pressure to an ECU (Electronic Control Unit) G.

The ECU G generates a command signal based on sensing signals from various sensors, such as the pressure signal from the pressure sensor F and an engine speed signal from an engine speed sensor, and sends the command signal to an EDU (Electronic Driving Unit) H.

In accordance with the command signal from the ECU G, the EDU H drives a pressure reducing valve I which is installed to the common rail E to regulate the fuel pressure in the common rail E to a first predetermined pressure.

More specifically, when the fuel pressure in the common rail E exceeds the first predetermined pressure, the pressure reducing valve I opens to release the high-pressure fuel from the common rail E, thereby keeping the fuel pressure in the common rail E at the first predetermined pressure.

The high-pressure fuel accumulated in the common rail E is supplied to a fuel injector J via a high-pressure passage 17. The fuel injector J is also driven by the EDU H and works to inject the high-pressure fuel into a cylinder of the engine.

It is to be appreciated that though there is illustrated only the single fuel injector J in the present embodiment, the fuel injection system generally includes a plurality of fuel injectors J according to the number of cylinders of the engine.

During operation, leakage of the high-pressure fuel occurs in the fuel injector J, as to be described in detail later, and the leak fuel is introduced into a low-pressure passage 8 and accumulates therein as low-pressure fuel.

A check valve K is hydraulically connected to the low-pressure passage 8 to regulate the fuel pressure in the low-pressure passage 8 to a second predetermined pressure. More specifically, when the fuel pressure in the low-pressure passage 8 exceeds the second predetermined pressure, the check valve K opens to return the excessive low-pressure fuel to the fuel tank A, thereby keeping the fuel pressure in the low-pressure passage 8 to the second predetermined pressure.

Further, the high-pressure fuel released from the common rail E is reduced in pressure by the pressure reducing valve I and supplied to the upstream of the check valve K via a supply passage 60 that is hydraulically connected to the low-pressure passage 8.

With the above configuration, when the fuel injection system is stopped, the fuel pressure in the low-pressure passage 8 decreases below the second predetermined pressure due to leakage of the low-pressure fuel from the check valve K.

However, when the fuel injection system is restarted along with the engine, the common rail E is quickly filled up with the high-pressure fuel by virtue of the sufficiently large discharge rate of the high-pressure pump D. Accordingly, in a short time after the restart, the pressure reducing valve I opens to release the high-pressure fuel from the common rail E to the upstream of the check valve K through pressure reduction, thereby promptly rebuilding the fuel pressure in the low-pressure passage 8 up to the second predetermined pressure.

In addition, the ECU G also controls, based on the sensing signals from the sensors, the high-pressure pump D to discharge the high-pressure fuel at an optimal rate. Further, the excessive fuel discharged from the feed pump C, which is not fed to the high-pressure pump D, is returned to the fuel tank A.

Figure 2:
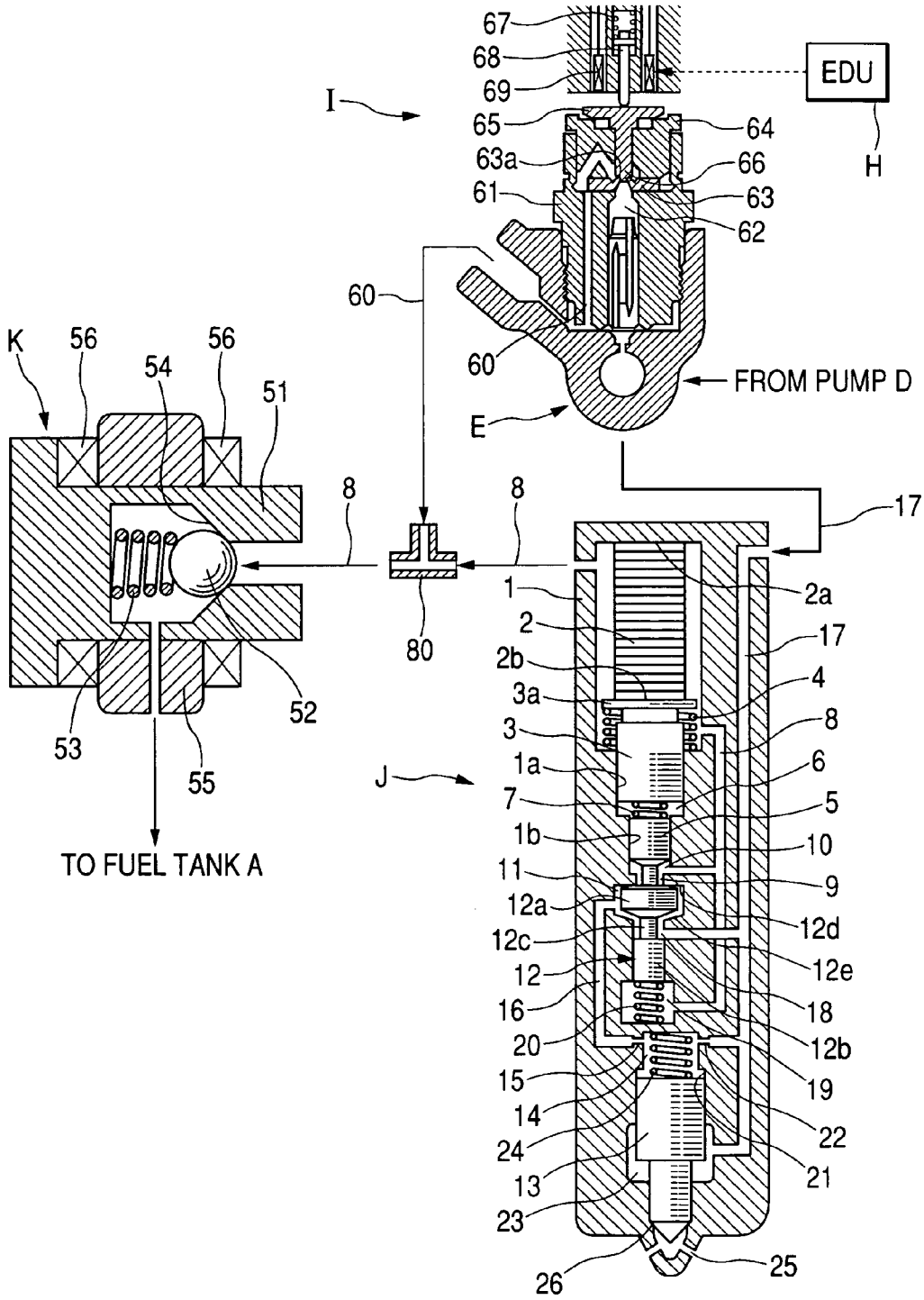
FIG. 2 is a schematic diagram showing the configuration of the fuel injection apparatus according to the embodiment of the invention.

FIG. 2 shows the configuration of the fuel injection apparatus according to the present embodiment.

As shown in FIG. 2, the fuel injection apparatus includes the fuel injector J, the pressure reducing valve I, and the check valve K.

The fuel injector J has a casing 1, in which a piezoelectric actuator 2 is disposed with an upper end 2*a* thereof abutting the casing 1. The piezoelectric actuator 2 (also called as piezo stack) is made of a laminate of lead zirconium titanate (PZT) layers and electrode layers, and is configured to expand and contract in the lamination direction (i.e., the vertical direction in FIG. 2). The structure of such piezoelectric devices is well known in the art, and the detailed explanation thereof is thus omitted here.

A large-diameter piston 3 is vertically slidably disposed in a large-diameter cylindrical chamber 1*a* formed in the casing 1. The large-diameter piston 3 has at an upper end thereof a flange portion 3*a* which is urged by a large-diameter piston spring 4 to abut a lower end 2*b* of the piezoelectric actuator 2. Further, in the casing 1, there is also formed a small-diameter cylindrical chamber 1*b*, in which a small-diameter piston 5 is vertically slidably disposed.

With the above configuration, there is defined a displacement amplifying chamber 6 in the casing 1, which is the room enclosed by a lower end surface of the large-diameter piston 3, an upper end surface of the small-diameter piston 5, and inner surfaces of the large-diameter and small-diameter cylindrical chambers 1*a* and 1*b*. Further, within the displacement amplifying chamber 6, there is provided a small-diameter piston 7 that urges the small-diameter piston 5 downward.

The displacement amplifying chamber 6 is filled with the low-pressure fuel, which has flowed thereinto from the low-pressure passage 8 via an annular gap between the outer surface of the large-diameter piston 3 and the inner surface of the large-diameter cylindrical chamber 1*a*. In other words, the displacement amplifying chamber 6 communicates with the low-pressure passage 8.

With the above configuration, the displacement amplifying chamber 6 can work to amplify and transmit to the small-diameter piston 5 a displacement of the large-diameter piston 3 by means of the low-pressure fuel filled therein.

More specifically, upon being energized, the piezoelectric actuator 2 expands vertically to displace the large-diameter piston 3 downward. With the displacement of the large-diameter piston 3, the low-pressure fuel in the displacement amplifying chamber 6 is compressed, thus causing the small-diameter piston 5 to be also displaced downward. Since the diameter of the large-diameter piston 3 is greater than that of the small-diameter piston 5, the displacement of the large-diameter piston 3 is accordingly amplified and transmitted to the small-diameter piston 5 through the low-pressure fuel in the displacement amplifying chamber 6.

In addition, when the large-diameter piston 3 moves downward to compress the low-pressure fuel in the displacement amplifying chamber 6, the low-pressure fuel leaks out from the displacement amplifying chamber 6 via the annular gap between the outer surface of the large-diameter piston 3 and the inner surface of the large-diameter cylindrical chamber 1*a*. However, when the large-diameter piston 3 moves upward to return to the initial position thereof, the fuel pressure in the displacement amplifying chamber 6 decreases below that in the low-pressure passage 8, so that the low-pressure fuel again flows into the displacement amplifying chamber 6 from the low-pressure passage 8 via the annular gap, thereby refilling up the chamber 6 with the low-pressure fuel. Moreover, lower part of the small-diameter piston 5 vertically moves in a small-diameter piston chamber 10, while upper part of the same vertically moves in the small-diameter cylindrical chamber 1*b*.

A three-way control valve 12 is disposed in a valve chamber 11 that constantly communicates with a back pressure chamber 14 via a main orifice 15 and a control passage 16.

The control valve 12 is in the form of a vertically movable piston and has a valve portion 12*a*, a sliding portion 12*b*, and a connecting portion 12*c*. The valve portion 12*a* has a large diameter and is disposed within the valve chamber 11. The sliding portion 12*b* is slidably disposed within a longitudinal bore that communicates, at an upper end thereof, with a high-pressure port 18 of the high-pressure passage 17. The connecting portion 12*c* connects the valve portion 12*a* and the sliding portion 12*b* and has a smaller diameter than both the valve portion 12*a* and the sliding portion 12*b*. The small-diameter connecting portion 12*c* is disposed within the high-pressure port 18, so that the high-pressure fuel from the high-pressure passage 17 can flow into the valve chamber 11 via an annular gap between the connecting portion 12*c* and the high-pressure port 18. In addition, under the longitudinal bore that receives the sliding portion 12*b*, there is provided a spring chamber 19, within which a valve spring 20 is disposed to urge the control valve 12 upward.

The back pressure chamber 14 is a room defined by an upper end surface of a nozzle needle 13 and the wall surface of a longitudinal bore 21. The back pressure chamber 14 constantly communicates with the high-pressure passage 17 via a sub orifice 22. Further, into the back pressure chamber 14, there is introduced the high-pressure fuel from the high-pressure passage 17 as control oil via the high-pressure port 18, the valve chamber 11, the control passage 16, and the main orifice 15. The introduced fuel produces a back pressure to the nozzle needle 13, which urges, along with the load of a spring 24 disposed within the back pressure chamber 14, the nozzle needle 13 downward to rest on a nozzle seat 26 formed in the casing 1.

On the other hand, a fuel sump 23 is provided within the casing 1, which constantly communicates with the high-pressure passage 17 and is thus filled with the high-pressure fuel all the time. The high-pressure fuel in the fuel sump 23 produces a front pressure to the nozzle needle 13, which urges the nozzle needle 13 upward to get away from the nozzle seat 26.

Upon upward movement of the control valve 12, an upper end surface of the valve portion 12*a* rests on an upper valve seat 12*d* that adjoins to the low-pressure port 9, thereby blocking the hydraulic communication between the valve chamber 11 and the low-pressure passage 8. Thus, the back pressure chamber 14 is brought into hydraulic communication with the high-pressure passage 17 via the main orifice 15, the control passage 16, the valve chamber 11, and the high-pressure port 18, so that the high-pressure fuel flows from the high-pressure passage 17 into the back pressure chamber 14, thereby increasing the back pressure to the nozzle needle 13. As a result, the nozzle needle 13 is pressed downward to rest on the nozzle seat 26, just as shown in FIG. 2.

On the contrary, upon downward movement of the control valve 12, a tapered under surface of the valve portion 12*a* rests on a lower valve seat 12*e* that adjoins to the high-pressure port 18, thereby blocking the hydraulic communication between the valve chamber 11 and the high-pressure passage 17. Thus, the back pressure chamber 14 is brought into hydraulic communication with the low-pressure passage 8 via the main orifice 15, the control passage 16, the valve chamber 11, and the small-diameter piston chamber 10, thereby decreasing the back pressure to the nozzle needle 13. As a result, the nozzle needle 13 is pressed upward by the front pressure to get away from the nozzle seat 26.

Here, if the inner diameter of the upper valve seat 12*d*, the inner diameter of the lower valve seat 12*e*, and the outer diameter of the sliding portion 12*b* of the control valve 12 are made approximately the same, the force of the high-pressure fuel in the valve chamber 11 urging the valve portion 12*a* of the control valve 12 upward approximately balances that urging the sliding portion 12*b* downward when the low-pressure port 9 is closed by the control valve 12. As a consequence, it is possible to minimize a driving force required for pushing the valve portion 12*a* of the control valve 12 downward to get away from the upper valve seat 12*d* for initiating the fuel injection. Preferably, the inner diameters of the upper and lower valve seats 12*d* and 12*e* are made slightly greater than the outer diameter of the sliding portion 12*b* of the control valve 12.

When the piezoelectric actuator 2 does not expand and thus has an original length thereof, the control valve 12 is urged upward by the high-pressure fuel in the valve chamber 11 and the load of the valve spring 20 to rest on the upper valve sear 12*d*, thereby closing the low-pressure port 9. Thus, the back pressure chamber 14 is hydraulically disconnected from the low-pressure passage 8 and becomes high in pressure, so that the nozzle needle 13 rests on the nozzle seat 26 and thus no fuel is injected through the injection holes 25.

When it is required to inject fuel, the piezoelectric actuator 2 is energized, so that it expands to push the large-diameter piston 3 downward, thereby increasing the fuel pressure in the displacement amplifying chamber 6. Subject to the increased fuel pressure in the displacement amplifying chamber 6, the small-diameter piston 5 moves downward to push the control valve 12, causing it to get way from the upper valve seat 12*d* and rest on the lower valve seat 12*e*. Consequently, the high-pressure port 18 is closed, and the back pressure chamber 14 is brought into hydraulic communication with the low-pressure passage 8 via the main orifice 15, the control passage 16, the valve chamber 11, the low-pressure port 9, and the small-diameter piston chamber 10. As a result, the fuel pressure in the back pressure chamber 14 is decreased, so that the nozzle needle 13 is moved upward to get way from the nozzle seat 26, thereby initiating the fuel injection through the injection holes 25.

When it is required to terminate the fuel injection, the piezoelectric actuator 2 is deenergized, so that it contracts to the original length thereof. Thus, the large-diameter piston 3 is moved upward along with the piezoelectric actuator 2 by the urging force of the large-diameter piston spring 4, thereby decreasing the fuel pressure in the displacement amplifying chamber 6. The decreased fuel pressure in the displacement amplifying chamber 6 causes the control valve 12 to be released from the pushing force of the small-diameter piston 5, so that the control valve 12 moves upward to get away from the lower valve seat 12*e* and re-rest on the upper valve seat 12*d*. Consequently, the low-pressure port 9 is re-closed, and the fuel pressure in the back pressure chamber 14 is increased by the high-pressure fuel flowing thereinto from the high-pressure passage 17 via the main and sub orifices 15 and 22. As a result, the nozzle needle 13 re-rests on the nozzle seat 26, thereby terminating the fuel injection. At this stage, if the inner diameter of the lower valve seat 12*e* is made slightly greater than the outer diameter of the sliding portion 12*b* of the control valve 12, the high pressure at the high-pressure port 18 would act on the control valve 12 upward, thus making it easier for the control valve 12 to get away from the lower valve seat 12*e*.

During operation of the fuel injector J, leak fuel from the high-pressure passage 17 is received by the low-pressure passage 8 and flows toward the check valve K.

The check valve K is of an ordinary type, wherein a ball-shaped valve 52 is disposed within a main body 51 and urged by a spring 53 to rest on a seat portion 54 of the main body 51.

When the valve 52 rests on the seat portion 54 of the main body 51, the leak fuel from the high-pressure passage 17 is accumulated in the low-pressure passage 8, thus developing the fuel pressure therein. However, when the fuel pressure developed in the low-pressure passage 8 comes to prevail over the urging force of the spring 53, the valve 52 is moved to get away from the seat portion 54 of the main body 51, thereby returning the leak fuel to the fuel tank A.

With such a function of the check valve K, the fuel pressure in the low-pressure passage 8 is kept at the second predetermined pressure, which corresponds to the urging force of the spring 53. In addition, there are further provided a union 55 for connecting the check valve K to a pipe leading to the fuel tank A and a gasket 56 for securing the fuel tightness between the main body 51 of the check valve K and the union 55.

As described previously, when there is contained adequate fuel in the fuel tank A, the feed pump C will suck in only the fuel. However, when there is left only an extremely small amount of the fuel in the fuel tank A, the feed pump C will suck in air along with the fuel from the fuel tank A. The sucked in air is then introduced into the high-pressure pump D, the common rail E, the high-pressure and low-pressure passages 17 and 8, and the displacement amplifying chamber 6.

Figure 3A:
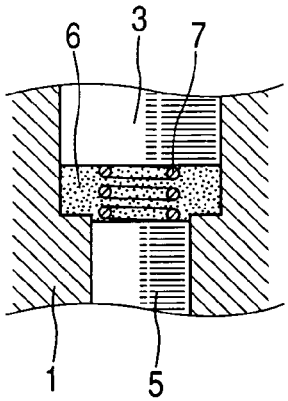
FIGS. 3A-3C are schematic diagrams showing the change of air bubbles in a displacement amplifying chamber in the fuel injection apparatus of FIG. 2.

During operation of the fuel injection apparatus, the low-pressure passage 8 is always filled with the leak fuel from the high-pressure passage 17 under the second predetermined pressure. Thus, in the displacement amplifying chamber 6 which communicates with the low-pressure passage 8, the sucked in air exists in the form of fine air bubbles, as illustrated in FIG. 3A, and the fuel density is kept high. Consequently, in the displacement amplifying chamber 6, the fuel compression by the large-diameter piston 3 can be normally carried out.

Figure 3B:
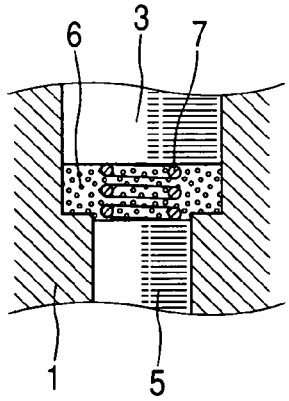

However, when the fuel injection system is stopped along with the engine, the low-pressure fuel in the low-pressure passage 8 comes to leak out via a slight clearance between the valve 52 and the seat portion 54 of the main body 51 of the check valve K, so that the fuel pressure in the low-pressure passage 8 decreases almost to the atmospheric pressure. Thus, in the displacement amplifying chamber 6, the fuel pressure decreases accordingly, so that the fine air bubbles grow into large air bubbles, as illustrated in FIG. 3B, and the fuel density decreases (i.e., the percentage of the air bubbles increases).

Further, when the fuel injection system is restarted along with the engine, a certain time period would be required for rebuilding the fuel pressure in the low-pressure passage 8 up to the second predetermined pressure if only the leak fuel from the high-pressure passage 17 is used to refill both the low-pressure passage 8 and the displacement amplifying chamber 6. In such a case, during the certain time period, the large-diameter piston 5 compresses the large bubbles instead of the fuel in the displacement amplifying chamber 6, so that the displacement of the large-diameter piston 3 cannot be amplified and transmitted to the small-diameter piston 5. Consequently, the fuel injector J cannot inject the high-pressure fuel into the cylinder of the engine in a timely manner.

To solve such a problem, in the present embodiment, the high-pressure fuel released from the common rail E is reduced in pressure by the pressure reducing valve I and supplied to the low-pressure passage 8 via the supply passage 60.

The pressure reducing valve I is of a solenoid type and includes a main body 61 that is fastened to the common rail E. In the core of the main body 61, there is provided a fuel introducing hole 62 for introducing the high-pressure fuel from the common rail E into the pressure reducing valve I. A cap 64 is fastened to the main body 61, thereby fixing a seat 63 to the main boy 61 at an upper end of the fuel introducing hole 62. The cap 64 has formed therein a central bore, in which a stem 65 is slidablly disposed. The stem 65 is made of a magnetic material and serves as an actuator. A ball-shaped valve 66 is fixed to a lower end of the stem 65. A spring 67 is provided which urges, via a rod 68, the stem 65 downward, thereby allowing the valve 66 to rest on a tapered seat portion 63*a* of the seat 63. A solenoid 69 is also provided which produces a magnetic attraction when energized.

In the pressure reducing valve I, when the solenoid 69 is deenergized, the valve 66 rests on the seat portion 63*a* of the seat 63 under the urging force of the spring 67, just as shown in FIG. 2, thereby blocking the hydraulic communication between the fuel introducing hole 62 and the supply passage 60. On the contrary, when the solenoid 69 is energized, the stem 65 is attracted upward by the magnetic attraction produced by the solenoid 69 to get away from the seat portion 23*a* of the seat 23, thereby bringing the fuel introducing hole 62 into hydraulic communication with the supply passage 60.

Further, the high-pressure fuel released from the common rail E is reduced in pressure when flowing through a small-diameter hole formed in the tapered seat portion 23*a* of the seat 23. In addition, the supply passage 60 is hydraulically connected to the low-pressure passage 8 through a connector 80.

With the above configuration, when the fuel injection system is stopped along with the engine, the solenoid 69 of the pressure reducing valve I is accordingly deenergized, so that the supply of the released fuel from the common rail E to the low-pressure passage 8 is shut off. On the other hand, the low-pressure fuel in the low-pressure passage 8 comes to leak out via the check valve K, thus decreasing the fuel pressure in the low-pressure passage 8. Consequently, the fuel pressure in the displacement amplifying chamber 6 decreases accordingly, so that in the displacement amplifying chamber 6, the fine air bubbles (as illustrated in FIG. 3A) grow into large air bubbles (as illustrated in FIG. 3B), and the fuel density decreases.

Further, when the fuel injection system is restarted along with the engine, the high-pressure fuel is supplied from the high-pressure pump D to the common rail E. Since the high-pressure pump D generally has a sufficiently large discharge rate, the fuel pressure in the common rail E exceeds the first predetermined pressure in a short time. Accordingly, in a short time after the restart of the engine, the solenoid 69 of the pressure reducing valve I is energized by the EDU H, thereby resuming the supply of the released fuel from the common rail E to the low-pressure passage 8.

Figure 3C:
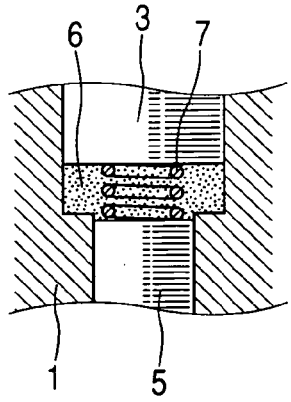

Due to the pressure reduction by the pressure reducing valve I, the fuel pressure at the outlet of the pressure reducing valve I is lower than in the common rail E but is still higher than at the outlet of the feed pump C (i.e., the inlet of the high-pressure pump D). Further, the amount of the high-pressure fuel released from the common rail E is sufficiently large. Consequently, the fuel pressure in the low-pressure passage 8 is rebuilt, in a short time after the restart of the engine, up to the second predetermined pressure, so that in the displacement amplifying chamber 6, the large air bubbles revert to the fine air bubbles, as illustrated in FIG. 3C, and the fuel density is recovered to the original level.

With the recovered fuel density in the displacement amplifying chamber 6, it becomes possible for the large-diameter piston 3 to effectively compress the fuel in the displacement amplifying chamber 6, thereby amplifying and transmitting to the small-diameter piston 5 the displacement thereof in a normal manner. Further, with the displacement of the small-diameter piston 5, the control valve 12 is moved downward, so that the back pressure chamber 14 is brought into hydraulic communication with the low-pressure passage 8 via the main orifice 15, the control passage 16, the valve chamber 11, and the low-pressure port 9, thus decreasing the fuel pressure therein. Consequently, with the decrease in the fuel pressure in the back pressure chamber 14, the nozzle needle 13 is moved upward to get away from the nozzle seat 26, thereby initiating the fuel injection through the injection holes 25.

Figure 4:
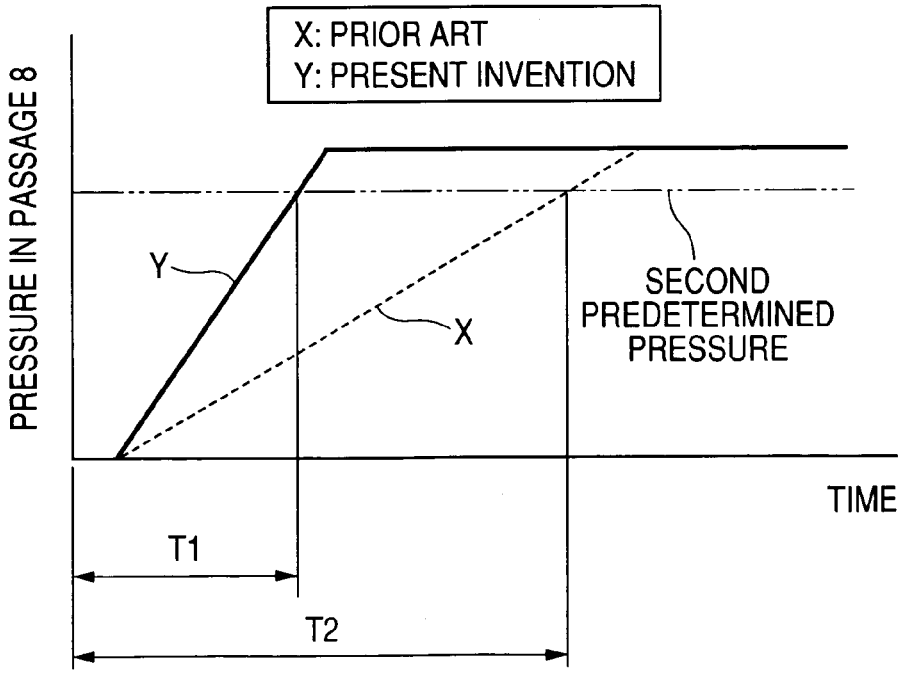
FIG. 4 is a graphical representation illustrating an advantage of the fuel injection apparatus of FIG.2 over an existing fuel injection apparatus.

FIG. 4 gives a comparison between a time T1, which is required for the fuel injection apparatus according to the present embodiment to rebuild the fuel pressure in the low-pressure passage 8 up to the second predetermined pressure, and a time T2 that is required for the previously-described existing fuel injection apparatus to rebuild the fuel pressure in the low-pressure passage up to the second predetermined pressure.

As seen from FIG. 4, the time T1 is much shorter than the time T2. That is, unlike the existing apparatus, the fuel injection apparatus according to the present embodiment can rebuild the fuel pressure in the low-pressure passage 8 up to the second predetermine pressure in a sufficiently short time after the restart of the engine, thereby initiating the fuel injection in a timely manner.

While the above particular embodiment of the invention has been shown and described, it will be understood by those who practice the invention and those skilled in the art that various modifications, changes, and improvements may be made to the invention without departing from the spirit of the disclosed concept.

For example, in the previous embodiment, the high-pressure fuel released from the common rail E is reduced in pressure by the pressure reducing valve I and supplied to that portion of the low-pressure passage 8 which connects the fuel injector J to the check valve K.

However, in a broad sense, the high-pressure passage 17 includes the high-pressure passage from the high-pressure pump D to the common rail E, the common rail E itself, the high-pressure passage from the common rail E to the fuel injector J, and the high-pressure passage formed inside the fuel injector J; the low-pressure passage 8 includes the low-pressure passage formed inside the fuel injector J and the low-pressure passage from the fuel injector J to the check valve K. In that sense, it is possible to supply the high-pressure fuel from any location in the high-pressure passage 17 to any location in the low-pressure passage 8 through pressure reduction by any suitable pressure reducing means or devices.

Moreover, in the previous embodiment, the fuel injection apparatus is incorporated in the common rail fuel injection system for a diesel engine of a motor vehicle.

However, the fuel injection apparatus may also be applied to any other fuel injection systems for internal combustion engines, such as a fuel injection system for a gasoline engine of a motor vehicle.

Such modifications, changes, and improvements are possible within the scope of the appended claims.

What is claimed is:

1. A fuel injection apparatus comprising:

a high-pressure passage configured to be filled with high-pressure fuel;

a low-pressure passage configured to be filled with low-pressure fuel;

an actuator;

a first piston configured to be displaced by the actuator;

a second piston;

a displacement amplifying chamber communicating with the low-pressure passage, the displacement amplifying chamber working to amplify and transmit to the second piston a displacement of the first piston by means of the low-pressure fuel therein;

a fuel injection mechanism configured to inject the high-pressure fuel into a cylinder of an internal combustion engine in response to the displacement of the second piston; and a fuel supplier working to supply the high-pressure fuel from the high-pressure passage through pressure reduction directly to the low-pressure passage without any device interposed between the fuel supplier and the low-pressure pressure passage, thereby minimizing a time required to fill up the displacement amplifying chamber with the low-pressure fuel after start of the engine.

2. The fuel injection apparatus as set forth in claim 1, wherein the fuel supplier is configured with:

a first regulating valve working to regulate pressure of the high-pressure fuel to a first predetermined pressure;

a supply passage hydraulically connecting the first regulating valve to the low-pressure passage; and a second regulating valve working to regulate pressure of the low-pressure fuel to a second predetermined pressure.

3. The fuel injection apparatus as set forth in claim 2, wherein the fuel injection apparatus is incorporated in a common rail fuel injection system for a diesel engine, and the high-pressure passage communicates with a common rail of the system.

4. The fuel injection apparatus as set forth in claim 3, wherein the first regulating valve is a pressure reducing valve that is installed to the common rail to regulate fuel pressure in the common rail.

5. The fuel injection apparatus as set forth in claim 2, wherein the second regulating valve is a check valve that is hydraulically connected to the low-pressure passage.

6. The fuel injection apparatus as set forth in claim 1, wherein the low-pressure passage is also configured to receive leak fuel from the high-pressure passage.

7. The fuel injection apparatus as set forth in claim 1, wherein the fuel injection mechanism is configured with:

a casing;

a pressure chamber formed within the casing;

a control valve configured to be actuated by the second piston to control fuel pressure in the pressure chamber;

a fuel sump formed within the casing, the fuel sump communicating with the high-pressure passage;

at least one injection hole formed through the casing to communicate with the fuel sump; and a nozzle needle configured to be moved within the casing in accordance with the fuel pressure in the pressure chamber to selectively open and close the injection hole.

* * * * *